US005688594A

United States Patent [19]

Lichscheidt et al.

[11] Patent Number: 5,688,594

[45] Date of Patent: Nov. 18, 1997

[54] HYBRID YARN

[75] Inventors: Bent Lichscheidt; Hans Knudsen; Henning Bak, all of Silkeborg, Denmark

[73] Assignee: Hoechst Aktiengesellschaft, Germany

[21] Appl. No.: 573,235

[22] Filed: Dec. 15, 1995

[30] Foreign Application Priority Data

Dec. 16, 1994 [DE] Germany ..... 44 44 917.8
Feb. 23, 1995 [DE] Germany ..... 19506316.3

[51] Int. Cl.[6] ..... D02G 3/00; D02G 3/02

[52] U.S. Cl. ..... 428/370; 428/371; 428/399; 428/369; 57/243; 57/244; 57/245

[58] Field of Search ..... 428/369, 371, 428/370, 399; 57/243, 244, 245, 908

[56] References Cited

U.S. PATENT DOCUMENTS

| | | | |
|---|---|---|---|
| 2,985,995 | 5/1961 | Bunting et al. . | |
| 4,275,117 | 6/1981 | Crandall | 428/323 |
| 4,539,249 | 9/1985 | Curzio | 428/175 |
| 4,581,225 | 4/1986 | Endo et al. | 428/113 |
| 4,818,318 | 4/1989 | McMahon et al. | 156/166 |
| 4,857,329 | 8/1989 | Plontges et al. | 428/102 |
| 4,874,563 | 10/1989 | McMahon et al. | 264/29.2 |
| 4,892,772 | 1/1990 | Su | 428/113 |
| 5,177,840 | 1/1993 | Laws | 28/220 |
| 5,206,078 | 4/1993 | Inoguchi et al. | 428/225 |
| 5,293,676 | 3/1994 | Geirhos et al. | 28/271 |
| 5,366,797 | 11/1994 | Rotger et al. | 428/229 |
| 5,424,123 | 6/1995 | Geirhos et al. | 428/370 |
| 5,429,868 | 7/1995 | Truckenmuller et al. | 428/399 |

FOREIGN PATENT DOCUMENTS

| | | |
|---|---|---|
| 0 138 294 | 4/1985 | European Pat. Off. . |
| 0 144 939 | 6/1985 | European Pat. Off. . |
| 0 156 600 | 5/1988 | European Pat. Off. . |
| 0 156 599 | 11/1988 | European Pat. Off. . |
| 0 325 153 | 7/1989 | European Pat. Off. . |
| 0 351 201 | 1/1990 | European Pat. Off. . |
| 0 369 395 | 5/1990 | European Pat. Off. . |
| 0 378 381 | 7/1990 | European Pat. Off. . |
| 0 336 507 | 7/1992 | European Pat. Off. . |
| 0 268 838 | 4/1993 | European Pat. Off. . |
| 0 551 832 | 7/1993 | European Pat. Off. . |
| 25 39 272 | 3/1976 | Germany . |
| 29 20 513 | 11/1979 | Germany . |
| 40 42 063 | 7/1982 | Germany . |
| 34 08 769 | 9/1985 | Germany . |
| 85/21108 | 2/1986 | Germany . |
| 42 18 860 A | 12/1993 | Germany . |
| WO 94/27606 | 10/1995 | WIPO . |

OTHER PUBLICATIONS

JP–A 04/353525 (Derwent) Dec. 8, 1992.

Chemiefasern/Testiltechnik 39/91 Jahrgang 1989 Seiten T 185–T187, T224–T228, T236.241.

*Primary Examiner*—Newton Edwards

*Attorney, Agent, or Firm*—Connolly & Hutz

[57] ABSTRACT

Described is a hybrid yarn consisting of at least two varieties of filaments, at least one variety (A) having a lower heat shrinkage and at least one variety (B) a higher heat shrinkage than the rest of the filaments of the hybrid yarn, wherein the first variety (A) of filaments has a dry heat shrinkage maximum of below 7.5%, the second variety (B) of filaments has a dry heat shrinkage maximum of above 10%, and its dry heat shrinkage tension maximum is so large that the total shrinkage force of the proportion of the second variety of filaments is sufficient to force the lower-shrinking filaments present to undergo crimping, the optionally present, further filament varieties (C) have dry heat shrinkage maxima within the range from 2 to 200% and at least one of the filament varieties (B) and/or (C) is a thermoplastic filament whose melting point is at least 10° C., preferably 20° to 100° C., in particular 30° to 70° C., below the melting point of the lower-shrinking component of the hybrid yarn.

Also described are a process for producing the hybrid yarn and the use of the hybrid yarn for producing permanent deformation capable textile sheet materials and fiber reinforced shaped articles.

13 Claims, No Drawings

HYBRID YARN

BACKGROUND OF THE INVENTION

The present invention relates to a hybrid yarn comprising reinforcing filaments and thermoplastic matrix filaments and to shrinkable and shrunk, permanent deformation capable, e.g. deep-drawable, textile sheet materials produced therefrom. The invention further relates to the shaped fiber reinforced thermoplastic articles which are produced by deforming the deformable textile sheets of the invention and which, owing to the uni- or multi-directionally disposed, essentially elongate reinforcing filaments, possess a specifically adjustable high strength in one or more directions.

Hybrid yarns from unmeltable (e.g. glass or carbon fiber) and meltable fibers (e.g. polyester fiber) are known. For instance, the patent applications EP-A-0,156,599, EP-A-0,156,600, EP-A-0,351,210 and EP-A-0,378,381 and Japanese Publication JP-A-04/353,525 concern hybrid yarns composed of nonmeltable fibers, e.g. glass fibers, and thermoplastic, for example polyester, fibers. Similarly, EP-A-0,551,832 and DE-A-2,920,513 concern combination yarns which, although ultimately bonded, are first present as hybrid yarn. European Patent EP-B-0,325,153 discloses a polyester yarn textile sheet material with a craquelé effect, which consists in part of cold-drawn, higher-shrinking polyester fibers and in part of hot-drawn, normal-shrinking polyester fibers. In this material, the craquelé effect is brought about by releasing the shrinkage of the higher-shrinking fibers. EP-B-0,336,507 discloses a process for densifying a polyester yarn textile sheet material which consists in part of cold-drawn, higher-shrinking polyester fibers and in part of hot-drawn, normal-shrinking polyester fibers. In this material, the densification is brought about by releasing the shrinkage of the higher-shrinking fibers.

It is also known to use hybrid yarns having a high-melting or unmeltable filament content and a thermoplastic lower-melting filament content to produce sheet materials which, by heating to above the melting point of the thermoplastic, lower-melting yarn component, can be converted into fiber reinforced, stiff thermoplastic sheets, a kind of organic sheet-metal, Various ways of producing fiber reinforced thermoplastic sheet are described in Chemiefasern/Textiltechnik' volume 39/91 (1989) pages T185 to T187, T224 to T228 and T236 to T240. The production starting from sheetlike textile materials composed of hybrid yarns is described there as an elegant way, which offers the advantage that the mixing ratio of reinforcing and matrix fibers can be very precisely controlled and that the drapability of textile materials makes it easy to place them in press molds (Chemiefasern/Textiltechnik' volume 39/91 (1989), page T186). As revealed on page T238/T239 of this publication, however, problems arise when the textile materials are to be deformed in two dimensions. Since the extensibility of the reinforcing threads is generally negligible, textile sheets composed of conventional hybrid yarns can only be deformed because of their textile construction. However, this deformability generally has narrow limits if creasing is to be avoided (T239), an experience that was confirmed by computer simulations. The solution of pressing textiles composed of reinforcing and matrix threads in molds has the disadvantage that partial squashing occurs, which leads to a dislocation and/or crimping of the reinforcing threads and an attendant decrease in the reinforcing effect. A further possibility discussed on page T239/T240 of producing three-dimensionally shaped articles having undislodged reinforcing threads would involve the production of three-dimensionally woven preforms, which, however, necessitates appreciable machine requirements, not only in the production of the preforms but also in the impregnation or coating of the thermoplastic.

A fundamentally different way of producing shaped fiber reinforced thermoplastic articles is to produce a textile sheet which consists essentially only of reinforcing yarns, placing it as a whole or in the form of smaller sections in or on molds, applying a molten or dissolved or dispersed matrix resin as impregnant, and allowing the resin to harden by cooling or evaporating the solvent or dispersing medium. This method can also be varied by impregnating the reinforcing textile before placing it in or on the mold and/or by pressing the reinforcing textile and a thermoplastic matrix resin into the desired shape in closed molds, at a working temperature at which the matrix resin will flow and completely enclose the reinforcing fibers. Reinforcing textiles for this technology are known for example from German Utility Model 85/21,108. The material described therein consists of superposed longitudinal and transverse thread layers connected together by additional longitudinal threads made of a thermoplastic material. A similar reinforcing textile material is known from EP-A-0,144,939. This textile reinforcement consists of warp and weft threads overwrapped by threads made of a thermoplastic material which cause the reinforcing fibers to weld together on heating.

A further reinforcing textile material is known from EP-A-0,268,838. It too consists of a layer of longitudinal threads and a layer of transverse threads, which are not interwoven, but one of the plies of threads has a significantly higher heat shrinkage capacity than the other. In the material known from this publication, the cohesion is brought about by auxiliary threads which do not adhere the layers of the reinforcing threads together but fix them loosely to one another so that they can still move relative to one another.

Improved deformability of reinforcing layers is the object of a process known from DE-A-4,042,063. In this process, a longitudinally deformable, namely heat-shrinking, auxiliary threads are incorporated into the sheet material intended for use as textile reinforcement. Heating releases the shrinkage and causes the textile material to contract somewhat, so that the reinforcing threads are held in a wavy state or in a loose overlooping.

DE-A-3,408,769 discloses a process for producing shaped fiber reinforced articles from thermoplastic material by using flexible textile structures consisting of substantially unidirectionally aligned reinforcing fibers and a matrix constructed from thermoplastic yarns or fibers. These semifinished products are given their final shape by heatable profile dies by melting virtually all the thermoplastic fibers.

A semifinished sheet material for producing shaped fiber reinforced thermoplastic articles is known from EP-A-0,369,395. This material consists of a thermoplastic layer embedding a multiplicity of spaced-apart parallel reinforcing threads of very low breaking extension which form deflections at regular intervals to form a thread reservoir. On deforming these semifinished sheet products, the deflections of the reinforcing threads are pulled straight—avoiding thread breakage.

From the fabrication standpoint the most advantageous semifinished products have a textile character, i.e. are drapable, and include both the reinforcing fibers and the matrix material. Of particular advantage will be semifinished products of this type which have a precisely defined weight ratio of reinforcing fibers to matrix material. The prior art drapable semifinished products with a defined ratio of reinforcing fibers and matrix material can be placed in press molds and pressed into shaped articles, but, after deforming, frequently no longer have the ideal arrangement and elongation of the reinforcing fibers because of the squashing during pressing. Reinforcing layers, for example those known from DE-A-4,042,063, are three-dimensionally deformable, for example by deep drawing, and generally make it possible to achieve the desired arrangement and elongation of the reinforcing fibers, but have to be embedded into the matrix material in an additional operation. Deep drawable fiber reinforced semifinished products, such as those known from EP-A-0,369,395, are difficult to manufacture because of the complicated wavelike arrangement of the reinforcing yarns.

SUMMARY OF THE INVENTION

It has now been found that the disadvantages of the prior art are substantially overcome by a sheetlike semifinished product which has textile character and which is either shrinkable (semifabricate I) or shrunk and capable of permanent deformation, for example by deep drawing, (semifabricate II), and which includes both reinforcing fibers and matrix material in a defined weight ratio. Such an advantageous semifabricate can be produced by weaving or knitting, but also by crosslaying or other known processes for producing sheetlike textiles on known machines, starting from a hybrid yarn which forms part of the subject-matter of this invention.

DETAILED DESCRIPTION OF THE INVENTION

Hereinafter and for the purposes of this invention, the terms "fiber", "fibers" and "fibrous" are also to be understood as meaning "filament", "filaments" and "filamentous".

The hybrid yarn of this invention consists of at least two varieties of filaments, at least one variety (A) having a lower heat shrinkage and at least one variety (B) a higher heat shrinkage than the rest of the filaments of the hybrid yarn, wherein

- the first variety (A) of filaments has a dry heat shrinkage maximum of below 7.5%,
- the second variety (B) of filaments has a dry heat shrinkage maximum of above 10%, and
- its dry heat shrinkage tension maximum is so large that the total shrinkage force of the proportion of the second variety of filaments is sufficient to force the lower-shrinking filaments present to undergo crimping,
- the optionally present, further filament varieties (C) have dry heat shrinkage maxima within the range from 2 to 200%
- and at least one of the filament varieties (B) and/or (C) is a thermoplastic filament whose melting point is at least 10° C., preferably 20° to 100° C., in particular 30° to 70° C., below the melting point of the lower-shrinking component of the hybrid yarn.

Advantageously the filaments have been interlaced. This has the advantage that, because of its improved bundle coherency, the hybrid yarn is easier to process into sheet materials on conventional machines, for example weaving or knitting machines, and that the intimate mixing of the reinforcing and matrix fibers results in very short flow paths for the molten matrix material and excellent, complete embedding of the reinforcing filaments of the thermoplastic matrix when producing shaped fiber reinforced thermoplastic articles from the sheetlike textile material. Advantageously the degree of interlacing is such that a measurement of the entanglement spacing with an ITEMAT hook drop tester (as described in U.S. Pat. No. 2,985,995) gives values of <200 mm, preferably within the range from 5 to 100 mm, in particular within the range from 10 to mm.

The hybrid yarn of this invention advantageously has a linear density of 100 to 24,000 dtex, preferably 150 to 18,000 dtex, in particular 200 to 10,000 dtex.

The proportion of the lower-shrinking filaments (A) is 20 to 90, preferably 35 to 85, in particular 45 to 75, % by weight, the proportion of the higher-shrinking filaments (B) is 10 to 80, preferably 15 to 45, in particular 25 to 55, % by weight and the proportion of the rest of the fibrous constituents is 0 to 70, preferably 0 to 50, in particular 0 to 30, % by weight of the hybrid yarn of this invention.

The proportion of the thermoplastic fibers whose melting point is at least 10° C. below the melting point of the low-shrinking fibers is 10 to 80, preferably 15 to 45, in particular 20 to 40, % by weight of the hybrid yarn of this invention.

To ensure an adequate deep-drawability, the maximum dry heat shrinkage difference $\Delta S_{MAX}$ between the lower-shrinking (A) and the higher-shrinking (B) variety of filament is more than 2.5% age points, for example 2.5 to 90% age points, preferably 5 to 75% age points, in particular 10–60% age points. If the deformability, for example the deep-drawability, requirements are less, it is also possible to select lower values for the dry heat shrinkage difference.

Advantageously the lower-shrinking filaments (A), which form the reinforcing filaments in the end product, i.e. in the three-dimensionally shaped fiber reinforced thermo-plastic article, have a dry heat shrinkage maximum of below 3%. These lower-shrinking filaments (A) advantageously have an initial modulus of above 600 cN/tex, preferably 800 to 25,000 cN/tex, in particular 2000 to 20,000 cN/tex, a tenacity of above 60 cN/tex, preferably 80 to 220 cN/tex, in particular 100 to 200 cN/tex, and a breaking extension of 0.01 to 20%, preferably 0.1 to 7.0%, in particular 1.0 to 5.0%.

In the interests of a typical textile character with good drapability, the lower-shrinking filaments (A) have linear densities of 0.1 to 20 dtex, preferably 0.4 to 16 dtex, in particular 0.8 to 10 dtex. In cases where the drapability does not play a big part, it is also possible to use reinforcing filaments having linear densities greater than 20 dtex.

The lower-shrinking filaments (A) are either inorganic filaments or filaments of high performance polymers or preshrunk and/or set organic filaments made of other organic polymers suitable for producing high tenacity filaments.

Examples of inorganic filaments are glass filaments, carbon filaments, filaments of metals or metal alloys such as steel, aluminum or tungsten; nonmetals such as boron; or metal or nonmetal oxides, carbides or nitrides such as aluminum oxide, zirconium oxide, boron nitride, boron carbide or silicon carbide; ceramic filaments, filaments of slag, stone or quartz. Preference for use as inorganic lower-shrinking filaments (A) is given to metal, glass, ceramic or carbon filaments, especially glass filaments.

Glass filaments used as lower-shrinking filaments (A) have a linear density of preferably 0.15 to 3.5 dtex, in particular 0.25 to 1.5 dtex.

Filaments of high performance polymers for the purposes of this invention are filaments of polymers which produce filaments having a very high initial modulus and a very high breaking strength or tenacity without or with only minimal drawing, and with or without a heat treatment following spinning. Such filaments are described in detail in Ullmann's Encyclopedia of Industrial Chemistry, 5th edition (1989), volume A13, pages 1 to 21, and also volume 21, pages 449 to 456. They consist for example of liquid crystalline polyesters (LCPs), poly (bisbenzimidazobenzophenanthroline) (BB), poly (amideimide)s (PAI), polybenzimidazole (PBI), poly(p-phenylenebenzobisoxazole) (PBO), poly(p-phenylenebenzobisthiazole) (PBT), polyetherketone (PEK), polyetheretherketone (PEEK), polyetheretherketoneketone (PEEKK), polyetherimides (PEI), polyether sulfone (PESU), polyimides (PI), aramids such as poly(m-phenyleneisophthalamide) (PMIA), poly(m-phenyleneterephthalamide) (PMTA), poly(p-phenyleneisophthalamide) (PPIA), poly(p-phenylenepyromellitimide) (PPPI), poly(p-phenylene) (PPP), poly(phenylene sulfide) (PPS), poly(p-phenyleneterephthalamide) (PPTA) or polysulfone (PSU).

Preferably the lower-shrinking filaments (A) are preshrunk and/or set aramid, polyester, polyacrylonitrile, polypropylene, PEK, PEEK, or polyoxymethylene filaments, in particular preshrunk and/or set aramid filaments or high modulus polyester filaments.

The shrinkability of the higher-shrinking filaments (B) has to be at least such that when its shrinkage is released, for example by heating, the reinforcing filaments become crimped, i.e. assume a wavelike configuration which a later area-enlarging deformation of a semifabricate produced from the hybrid yarn of this invention will reverse, so that, in the three-dimensionally shaped fiber reinforced thermoplastic end product, the reinforcing filaments will be essentially back in the elongated state. The higher-shrinking filaments (B) advantageously have a dry heat shrinkage maximum of above 20%. For end products resulting from a relatively small three-dimensional deformation, however, the dry heat shrinkage maximum can also be made smaller.

As mentioned above, the more highly shrinking filaments shall cause the reinforcing filaments to contract so that they become crimped, i.e. form a wavy line. The shrinkage force of the more highly shrinking filaments has to be sufficient to perform this function.

The higher-shrinking filaments (B) therefore advantageously have a dry heat shrinkage tension maximum of 0.1 to 3.5 cN/tex, preferably 0.25 to 2.5 cN/tex.

The higher-shrinking filaments (B) have an initial modulus of above 200 cN/tex, preferably 220 to 650 cN/tex, in particular 300 to 500 cN/tex, a tenacity of above 12 cN/tex, preferably 40 to 70 cN/tex, in particular 40 to 65 cN/tex, and an elongation at break of 20 to 50%, preferably 15 to 45%, in particular 20 to 35%.

Depending on the compliance or drapability required for the semifabricate, they have linear densities of 0.5 to 25 dtex, preferably 0.7 to 15 dtex, in particular 0.8 to 10 dtex.

The higher-shrinking filaments (B) are synthetic organic filaments. They can be made of the abovementioned high performance polymers, provided they can be made with the required dry heat shrinkage maximum and the required dry heat shrinkage tension. The only requirement here is that the above-indicated dry heat shrinkage difference $\Delta S_{MAX}$ between the filament varieties (A) and (B) is achieved. An example are filaments (B) made of polyetherimide (PEI). However, other spinnable polymers can be used as polymer material of which the higher-shrinking filaments (B) are made, for example vinylpolymers such as polyolefins, polyvinyl esters, polyvinyl ethers, poly(meth)acrylates, poly (aromatic vinyl), polyvinyl halides and also the various copolymers, block and graft polymers, liquid crystal polymers or else polyblends.

Specific representatives of these groups are polyethylene, polypropylene, polybutene, polypentene, polyvinyl chloride, polymethyl methacrylate, poly(meth)acrylonitrile, modified or unmodified polystyrene or multiphase plastics such as ABS.

Also suitable are polyaddition, polycondensation, polyoxidation or cyclization polymers. Specific representatives of these groups are polyamides, polyurethanes, polyureas, polyimides, polyesters, polyethers, polyhydantoins, polyphenylene oxide, polyphenylene sulfide, polysulfones, polycarbonates and also their mixed forms, mixtures and combinations with each other and with other polymers or polymer precursors, for example nylon-6, nylon-6,6, polyethylene terephthalate or bisphenol A polycarbonate.

Preferably the higher-shrinking filaments (B) are drawn polyester, polyamide or polyetherimide filaments. Particular preference produces higher-shrinking filaments (B) is given to polyester POY filaments, in particular to polyethylene terephthalate filaments.

It is particularly preferable for the higher-shrinking filaments (B) simultaneously to be the thermoplastic filaments (matrix filaments) whose melting point is at least 10° C. below the melting point of the lower-shrinking filaments (reinforcing filaments) of the hybrid yarn of this invention.

In many cases it is desirable for the three-dimensionally shaped thermoplastic articles produced from the hybrid yarns of this invention via the sheetlike semifabricates to contain auxiliary and additive substances, for example fillers, stabilizers, delustrants or color pigments. In these cases it is advantageous for at least one of the filament varieties of the hybrid yarn to additionally contain such auxiliary and additive substances in an amount of up to 40% by weight, preferably up to 20% by weight, in particular up to 12% by weight of the weight of the fibrous constituents. Preferably the proportion of the thermoplastic fiber whose melting point is at least 10° C. lower than the melting point of the low-shrinking fibers, i.e. the matrix fibers, contains the additional auxiliary and additive substances in an amount of up to 40% by weight, preferably up to 20% by weight, in particular up to 12% by weight of the weight of the fibrous constituents. Preferred auxiliary and additive substances for inclusion in the thermoplastic fiber content are fillers, stabilizers and/or pigments.

The above-described hybrid yarn is altogether shrinkable owing to the shrinkable fiber variety (B) it contains. If this hybrid yarn is subjected to a heat treatment at a temperature at which the fiber variety (B) shrinks, then the fibers of variety (A) develop a crimp, i.e. they form a sequence of small or larger arcs, in order that their unchanged length may now be accommodated in the shorter yarn length. In this shrunk yarn, filaments of variety (A) are thus crimped and the filaments of variety (B) shrunk. This yarn too forms part of the subject-matter of the present invention.

End products produced from the hybrid yarn of this invention are shaped fiber reinforced thermoplastic articles. These are produced from the hybrid yarn via sheetlike textile structures (semifabricates I and II) which are capable of permanent three-dimensional deformation when the reinforcing filaments present therein are in the crimped state.

The present invention accordingly also provides textile sheet materials (semifabricate I) consisting of or comprising a proportion of the above-described hybrid yarn of this invention sufficient to significantly influence the shrinkage capacity of the textile sheet materials. The sheet materials of this invention can be wovens, knits, stabilized lays or bonded or unbonded random-laid webs. Preferably the sheet material is a knit or a stabilized, unidirectional or multidirectional lay, but in particular a woven.

In principle, the woven sheets may have any known weave construction, such as plain weave and its derivatives, for example rib, basket, huckaback or mock leno, twill and its many derivatives, of which only herringbone twill, flat twill, braid twill, lattice twill, cross twill, peak twill, zigzag twill, shadow twill or shadow cross twill are mentioned as examples, or satin/sateen with floats of various lengths. (For the weave construction designations cf. DIN 61101). The set of each of the woven sheets varies within the range from 10 to 60 threads/cm in warp and weft, depending on the use for which the material is intended and depending on the linear density of the yarns used in making the fabrics. Within this range of from 10 to 60 threads/cm in warp and weft, the sets of the woven fabric plies can be different or, preferably, identical.

In a further preferred embodiment of the textile materials of this invention, the textile sheets are knitted.

A knitted textile material according to this invention can have rib, purl or plain construction and their known variants and also Jacquard patterning. Rib construction also comprehends for example its variants of plated, openwork, ribbed, shogged, weave, tuckwork, knob and also the interlock construction of 1×1 rib crossed. Purl construction also comprehends for example its variants of plated, openwork, interrupted, shogged, translated, tuckwork or knob. Plain construction also comprehends for example its variants of plated, floating, openwork, plush, inlay, tuckwork or knob.

The woven or knitted constructions are chosen according to the use intended for the textile material of this invention, usually from purely technical criteria, but occasionally also from decorative aspects.

As mentioned earlier, these novel sheet materials possess very good permanent deformation capability, in particular by deep drawing, when the reinforcing filaments present therein are in the crimped state.

The present invention accordingly further provides permanent deformation capable textile sheet materials (semifabricate II) consisting of or comprising a proportion of the hybrid yarn of claim 1 sufficient to significantly influence the shrinkage capacity of the textile sheet materials, wherein the lower-shrinking filaments (A) of the hybrid yarn are crimped. Preferably the lower-shrinking filaments of the hybrid yarn are crimped by 5 to 60%, preferably 12 to 48%, in particular 18 to 36%.

The present invention also provides fiber reinforced shaped articles consisting of 20 to 90, preferably 35 to 85, in particular 45 to 75, % by weight of a sheetlike reinforcing material composed of low-shrinking filaments embedded in 10 to 80, preferably 15 to 45, in particular 25 to 55, % by weight of a thermoplastic matrix, 0 to 70, preferably 0 to 50, in particular 0 to 30% by weight of further fibrous constituents and additionally up to 40% by weight, preferably up to 20% by weight, in particular up to 12% by weight, of the weight of the fibrous and matrix constituents, of auxiliary and additive substances.

Sheetlike reinforcing materials for embedding in the thermoplastic matrix can be sheets of parallel filaments arranged unidirectionally or, for example, multidirectionally in superposed layers, and are essentially elongate. However, they can also be wovens or knits, preferably wovens.

The fiber reinforced shaped article of this invention includes as auxiliary and additive substances fillers, stabilizers and/or pigments depending on the requirements of the particular application. One characteristic of these shaped articles is that they are produced by deforming a textile sheet material composed of the above-described hybrid yarn, in which the reinforcing filaments are crimped, at a temperature which is above the melting point of the thermoplastic filaments and below the melting point of the lower-shrinking filaments.

Here it is of importance that they are produced by an extensional deformation in which the crimped reinforcing filaments of the semifabricate are elongated and straightened at least in the region of the deformed parts.

The melting point of the filaments used for producing the hybrid yarn of this invention was determined in a differential scanning calorimeter (DSC) at a heating-up rate of 10° C./min. To determine the dry heat shrinkage and the temperature of maximum dry heat shrinkage of the filaments used, the filament was weighted with a tension of 0.0018 cN/dtex and the shrinkage-temperature diagram was recorded. The two values in question can be read off the curve obtained. To determine the maximum shrinkage force, a shrinkage force/temperature curve was continuously recorded at a heating-up rate of 10° C./min and at an inlet and outlet speed of the filament into and out of the oven. The two desired values can be taken from the curve.

The determination of the entanglement spacing as a measure of the degree of interlacing was carried out according to the principle of the hook-drop test described U.S. Pat. No. 2,985,995 using an ITEMAT tester.

This invention further provides a process for producing the hybrid yarn of this invention, which comprises interlacing filaments (A) having a lower heat shrinkage, filaments (B) having a higher sheet shrinkage and optionally further filament varieties (C) in an interlacing means to which means they are passed with an overfeed of 0 to 50%, wherein the first variety (A) of filaments has a dry heat shrinkage maximum of below 7.5%, the second variety (B) of filaments has a dry heat shrinkage maximum of above 10%, and the dry heat shrinkage tension maximum of the higher-shrinking filaments is so large that the total shrinkage force of the proportion of the second variety of filaments is sufficient to force the lower-shrinking filaments used to undergo crimping, the optionally used, further filament varieties (C) have dry heat shrinkage maxima within the range from 2 to 200% and at least one of the filament varieties (B) and/or (C) is a thermoplastic filament whose melting point is at least 10° C., preferably 20° to 100° C., in particular 30° to 70° C., below the melting point of the lower-shrinking filaments.

The interlacing preferably corresponds to an entanglement spacing of below 200 mm, preferably within the range from 5 to 100 mm, in particular within the range from 10 to 30 mm.

The process steps required for producing a shaped fiber reinforced thermoplastic article from the hybrid yarn of this invention likewise form part of the subject-matter of the present invention.

The first of these steps is a process for producing a textile sheet material (semifabricate I) by weaving, knitting, laying or random laydown of the hybrid yarn of this invention with or without other yarns, which comprises using a hybrid yarn of this invention having the features described above and selecting the proportion of hybrid yarn so that it significantly influences the shrinkage capacity of the sheet material. Preferably the proportion of hybrid yarn used relative to the total amount of woven, knitted, laid, or randomly laid down yarn is 30 to 100% by weight, preferably 50 to 100% by weight, in particular 70 to 100% by weight.

Preferably the sheet material is produced by weaving with a set of 4 to 20 threads/cm or by unidirectional or multidirectional laying of the hybrid yarns and stabilization of the lay by means of transversely laid binding threads or by local or whole-area bonding.

The second of these processing steps from the hybrid yarn of this invention to the end product is a process for producing a permanent deformation capable sheet material (semifabricate II), which comprises, after the production of a sheet material by weaving, knitting, laying or random laydown of a hybrid yarn with or without other yarns, subjecting the sheet material obtained to a heat treatment at a temperature below the melting temperature of the lowest-melting fiber material or to an infrared treatment until it has shrunk in at least one direction by 3 to 120% of its initial size.

Preferably the heat treatment is carried out at a temperature of 85° to 250° C., preferably 95° to 220° C.

It is particularly preferable and advantageous for the extent of shrinkage is controlled through appropriate choice of the temperature and duration of the heat treatment so that the shrinkage substantially corresponds to the extension which takes place in processing into the fiber reinforced shaped article.

Alternatively, the permanent deformation capable sheet material of this invention wherein the reinforcing filaments (A) are present in the crimped state and can of course also be obtained by producing them by the above-described processes by weaving, knitting, laying or random laydown of hybrid yarn with or without other yarns using a shrunk hybrinb yarn of this invention in which the filaments (A) are already present in the crimped state and filaments (B) in the shrunk state, the proportion of hybrid yarn being so chosen that it significantly influences the extensibility of the sheet material. The only criterion which has to be considered is that the tensile stress in the production of the sheet material does not exceed the yield stress of the shrunk hybrid yarns of this invention.

The last step of processing the hybrid yarn of this invention is a process for producing a fiber reinforced shaped article consisting of 20 to 90, preferably 35 to 85, in particular 45 to 75, % by weight of a preferably sheetlike reinforcing material composed of low-shrinking filaments embedded in 10 to 80, preferably 15 to 45, in particular 25 to 55, % by weight of a thermoplastic matrix, and 0 to 70, preferably 0 to 50, in particular 0 to 30% by weight of further fibrous constituents and additionally up to 40% by weight, preferably up to 20% by weight, in particular up to 12% by weight, of the weight of the fibrous and matrix constituents, of auxiliary and additive substances, which comprises producing it by deforming an above-described permanent deformation capable textile sheet material of this invention (semifabricate II) at a temperature which is above the melting point of the thermoplastic filaments and below the melting point of the low-shrinking filaments.

The Examples which follow illustrate the production of the hybrid yarn of this invention, of the semifabricates I and II of this invention, and of a shaped fiber reinforced thermoplastic article of this invention.

EXAMPLE 1

A 2×680 dtex multifilament glass yarn and a 5×300 dtex (=1500 dtex) 64 filament polyethylene terephthalate POY yarn are conjointly fed into an interlacing jet where they are interlaced by a compressed air stream. The polyester POY yarn has a dry heat shrinkage maximum of 65%, with a peak temperature of 100° C., and a dry heat shrinkage tension maximum of 0.3 cN/tex at a peak temperature of 95° C.; its melting point is 250° C. The interlaced hybrid yarn obtained has a linear density of 2260 dtex; the entanglement spacing, as measured with the ITEMAT tester, is 19.4 mm. The yarn has a tenacity of 25.8 cN/tex and a breaking extension of 3.5%. Samples of the hybrid yarn were shrunk at 95°, 150° or 220° C. for 1 minute. The shrinkage obtained was 56–57%. The stress-strain diagram of the shrunk yarns shows that initially an extension of the PET filaments took place. Following an extension of 130–150%, the glass filaments begin to take the strain, only for the yarn to break shortly thereafter.

EXAMPLE 2

A 220 dtex 200 filament high modulus aramid yarn and a 2×111 dtex 128 filament polyethylene terephthalate POY yarn are conjointly fed into an interlacing jet where they are interlaced by a compressed air stream. The polyester POY yarn has a dry heat shrinkage maximum of 65%, with a peak temperature of 100° C., and a dry heat shrinkage tension maximum of 0.3 cN/tex at a peak temperature of 95° C.; its melting point is 250° C. The interlaced hybrid yarn obtained has a linear density of 440 dtex, the entanglement spacing measured with the ITEMAT tester 21 mm, and the maximum shrinkage occurs at 98° C. and amounts to 68%.

The method described in Examples 1 and 2 can also be used to produced the novel hybrid yarns of the table. The abbreviations used in the table have the following meanings:

PET=polyethylene terephthalate; PBT=polybutylene terephthalate

PEI=polyetherimide (®ULTEM from GE Plastics)

POY=partially oriented yarn spun at a spinning take-off speed of 3500 m/min, undrawn.

TABLE

| | Low-shrinking component | | | | | Higher-shrinking component | | | | Hybrid |
|---|---|---|---|---|---|---|---|---|---|---|
| Example No | Material | Melting point [°C.] | Breaking strength [cN/tex] | Linear density | % by weight | Material | Melting point [°C.] | Linear density | % by weight | yarn Linear density |
| 2 | Glass | >500 | 110 | 6000 dtex | 66 | PET-POY | 250 | 10 × 300 dtex 64 f | 34 | 9000 |
| 3 | Glass | >500 | 110 | 3000 dtex | 66 | PET-POY | 250 | 5 × 300 dtex 64 f | 34 | 4500 |
| 4 | Glass | >500 | 110 | 1360 dtex | 60 | PET-POY | 250 | 3 × 300 dtex 64 f | 40 | 2260 |
| 5 | Glass | >500 | 110 | 2 × 680 dtex | 60 | PET-POY | 250 | 3 × 300 dtex 64 f | 40 | 2260 |
| 6 | Glass | >500 | 110 | 680 dtex | 36 | PET-POY | 250 | 4 × 285 dtex 64 f | 64 | 1850 |
| 7 | Aramid | >500 | 200 | 100 dtex 100 filaments | 47 | PET-POY | 250 | 110 dtex 128 f | 53 | 210 |
| 8 | HMA* | >500 | 200 | 100 dtex 100 filaments | 49 | PET-POY | 250 | 4 × 285 dtex 64 f | 51 | 2250 |
| 9 | Glass | >500 | 110 | 660 dtex | 53 | PET-POY | 250 | 2 × 285 dtex 64 f | 47 | 1230 |
| 10 | Glass | >500 | 110 | 680 dtex | 38 | PET-POY | 250 | 5 × 220 dtex 24 f | 62 | 1780 |
| 11 | Glass | >500 | 110 | 2 × 660 dtex | 64 | PET | 256 | 4 × 180 dtex 96 f | 36 | 2040 |
| 12 | ® TWARON | >500 | 200 | 1210 dtex 750 filaments | 80 | PEI | 380 | 300 dtex | 20 | 1510 |

*HMA = High modulus aramid

EXAMPLE 13

The hybrid yarn produced in Example 1 is woven up into a fabric with a plain weave. The number of ends per cm is 12.6, the number of picks per cm is 10.6. This fabric (semifabricate I) is freely shrunk in an oven at 200° C. for one minute. The result is a shrinkage of 50% in warp and weft. The resulting fabric (semifabricate II) exhibits very good permanent deformation capability. The maximally possible area enlargement on deep drawing is above 250%.

EXAMPLE 14

The hybrid yarn produced in Example 1 is woven up into a fabric with a plain weave. The number of ends per cm is 10.4, the number of picks per cm is 10.6. This fabric (semifabricate I) is tenter-shrunk in an oven at 200° C. for one minute. A shrinkage of 4% is permitted in warp and weft. The resulting fabric (semifabricate II) exhibits very good permanent deformation capability. The maximally possible area enlargement on deformation is about 8%.

EXAMPLE 15

The hybrid yarn produced in Example 1 is woven up into a fabric with a plain weave. The number of ends per cm is 7.4, the number of picks per cm is 8.2. This fabric (semifabricate I) is tenter-shrunk in an oven at 200° C. for one minute. A shrinkage of 12% in warp and 15% in weft is permitted. The resulting fabric (semifabricate II) exhibits very good permanent deformation capability. The maximally possible area enlargement on deformation is about 30%.

EXAMPLE 16

The hybrid yarn produced in Example 1 is woven up into a fabric with a plain weave. The number of ends per cm is 12.6, the number of picks per cm is 5.2. This fabric (semifabricate I) is freely shrunk in an oven at 200° C. for one minute. The result is a shrinkage of 50% in warp and no shrinkage in weft. The resulting fabric (semifabricate II) exhibits very good permanent deformation capability. The maximally possible area enlargement on deep drawing is above 50%.

EXAMPLE 17

A semifabricate II produced as described in Example 15 is drawn into a fender shape and heated at 280° C. for 3 minutes. After cooling down to about 80° C., the crude fender shape can be taken out of the deep-drawing mold. The shaped fiber-reinforced thermoplastic article obtained has an excellent strength. Its reinforcing filaments are very uniformly distributed and substantially elongate.

The article is finished by cutting, smoothing and coating.

What is claimed is:

1. A hybrid yarn comprising at least two varieties of filaments, at least one variety (A) having a lower heat shrinkage and at least one variety (B) having a higher heat shrinkage than the rest of the filaments of the hybrid yarn, wherein the first variety (A) of filaments are crimped and comprise polymer filaments selected from the group consisting of aramid, polyester, polyacrylonitrile, polypropylene, PEK, PEEK and polyoxymethylene, and inorganic filaments selected from the group consisting of metal, glass, ceramic and carbon having a linear density of 0.1 to 20 dtex, the second variety (B) of filaments comprises polymer filaments, and the yarn having a dry heat shrinkage tension maximum so large that the total shrinkage force of the proportion of the second variety (B) of filaments is sufficient to force the lower-shrinking filaments present to undergo crimping.

2. The hybrid yarn of claim 1 wherein the filaments are interlaced.

3. The hybrid yarn of claim 1 having a linear density of from 100 to 24,000 dtex.

4. The hybrid yarn of claim 1 wherein the proportion of the lower-shrinking filaments (A) is 20 to 90% by weight, the proportion of the higher-shrinking filaments (B) is 10 to 80% by weight and the proportion of the rest of the fibrous constituents is 0 to 70% by weight of the hybrid yarn.

5. The hybrid yarn of claim 1 wherein the proportion of the thermoplastic fiber whose melting point is at least 10° C. below the melting point of the low-shrinking fiber is 10 to 80% by weight of the hybrid yarn.

6. The hybrid yarn of claim 1 wherein the lower-shrinking filaments (A) have an initial modulus of above 600 cN/tex in particular 2000 to 20,000 cN/tex, a tenacity of above 60 cN/tex, and a breaking extension of 0.01 to 20%.

7. The hybrid yarn of claim 1 wherein the lower-shrinking filaments (A) are inorganic.

8. The hybrid yarn of claim 1 wherein the lower-shrinking filaments (A) are glass filaments.

9. The hybrid yarn of claim 1 wherein the lower-shrinking filaments (A) are aramid filaments or high modulus polyester filaments.

10. The hybrid yarn of claim 1 wherein the higher-shrinking filaments (B) are synthetic filaments.

11. The hybrid yarn of claim 1 wherein the higher-shrinking filaments (B) are selected from the group consisting of drawn polyester, polyamide and polyetherimide filaments.

12. The hybrid yarn of claim 1 wherein the higher-shrinking filaments (B) are polyester POY filaments.

13. The hybrid yarn of claim 1 wherein the higher-shrinking filaments (B) are polyethylene terephthalate filaments.

* * * * *